US008018475B2

(12) United States Patent
Lee et al.

(10) Patent No.: US 8,018,475 B2
(45) Date of Patent: Sep. 13, 2011

(54) CIRCUITS, DISPLAYS AND APPARATUS FOR PROVIDING OPPOSING OFFSETS IN AMPLIFIER OUTPUT VOLTAGES AND METHODS OF OPERATING SAME

(75) Inventors: Jihang Lee, Gyeonggi-do (KR); Jaehun Lee, Gyeonggi-do (KR); Jihyun Lee, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 1273 days.

(21) Appl. No.: 11/362,963

(22) Filed: Feb. 27, 2006

(65) Prior Publication Data

US 2006/0290619 A1 Dec. 28, 2006

(30) Foreign Application Priority Data

Jun. 22, 2005 (KR) ..... 10-2005-0053866

(51) Int. Cl.
*G09G 5/10* (2006.01)

(52) U.S. Cl. ..... 345/690; 345/83

(58) Field of Classification Search ..... 345/76–77, 345/83, 88, 89, 690
See application file for complete search history.

(56) References Cited

U.S. PATENT DOCUMENTS

| | | | | |
|---|---|---|---|---|
| 5,434,599 | A * | 7/1995 | Hirai et al. | 345/100 |
| 5,592,194 | A * | 1/1997 | Nishikawa | 345/667 |
| 2002/0171613 | A1* | 11/2002 | Goto et al. | 345/87 |
| 2002/0190974 | A1* | 12/2002 | Morita | 345/208 |
| 2003/0146923 | A1* | 8/2003 | Nakahira et al. | 345/690 |
| 2004/0108988 | A1* | 6/2004 | Choi | 345/96 |
| 2004/0196231 | A1* | 10/2004 | Goto et al. | 345/87 |
| 2005/0078077 | A1* | 4/2005 | Hagino | 345/100 |
| 2005/0231497 | A1* | 10/2005 | Harada | 345/204 |

FOREIGN PATENT DOCUMENTS

TW 425539 B 3/2001

OTHER PUBLICATIONS

Notice to Submit Response to an Office Action of the Taiwan Patent Application No. 095114864, issued Apr. 2, 2010.

* cited by examiner

*Primary Examiner* — Chanh Nguyen
*Assistant Examiner* — Robert Stone
(74) *Attorney, Agent, or Firm* — Myers Bigel Sibley & Sajovec

(57) ABSTRACT

A driver circuit can include a channel amplifier configured to operate in a first mode to provide a channel amplifier output including a positive offset voltage responsive to a first state of a control signal and configured to operate in a second mode to provide the channel amplifier output including a negative offset voltage responsive to a second state of the control signal. Related displays, apparatus, and methods are disclosed.

16 Claims, 8 Drawing Sheets

CIRCUITS, DISPLAYS AND APPARATUS FOR PROVIDING OPPOSING OFFSETS IN AMPLIFIER OUTPUT VOLTAGES AND METHODS OF OPERATING SAME

CROSS-REFERENCE TO RELATED APPLICATION

This application claims the benefit of Korean Patent Application No. 2005-0053866, filed Jun. 22, 2005, the disclosure of which is hereby incorporated herein by reference in its entirety.

FIELD OF THE INVENTION

The invention relates to integrated circuits, and more particularly, to driver circuits for displays and related apparatus and methods of operating.

BACKGROUND

A gamma characteristic is a non-linear relationship that approximates the relationship between encoded luminance in a system (such as a television display) and the actual desired image brightness. Displays that may require a more linear relationship between encoded luminance and image brightness can use what is commonly referred to as "gamma correction" to provide a more desirable image for display.

One type of display device that can benefit from gamma correction is an Active Matrix Organic LED (AMOLED) based display which may be relatively efficient compared to TFT-LCD based displays, as an AMOLED based display may more faithfully reproduce images including slight variations in luminence between pixels. However, one of the challenges associated with providing images on an AMOLED based display is that slight variations in the voltages generated by drivers may be manifested in the image displayed by the AMOLED based display.

One approach for driving data to an AMOLED based display is commonly referred to as "gamma buffered driving," which is depicted in FIG. 1. As shown in FIG. 1, a gray voltage generator 110 that is configured to generate N gray voltage levels provided to a gamma buffer 120. The N gray voltage levels represent the range of luminence values that can be provided on any particular channel of a display. The gamma buffer 120 amplifies the respective gray voltage level to provide gamma corrected luminence values so that image quality is maintained in view of the gamma characteristics of the display. A plurality of selectors 122 select the gamma corrected gray voltage levels to be driven to a respective channel (CH1-CHM) based on digital data provided to the selector 122.

According to the gamma buffered driving approach shown in FIG. 1, different loading on the different channels (Ch1-ChM) may introduce variations between voltage levels driven to the respective channels. Furthermore, if the gamma buffered driving approach shown in FIG. 1 is used to drive a high definition display, the size of the gamma buffer 120 may need to be large (i.e., N may be large).

Another approach to driving data to a display is commonly referred to as "channel buffered driving," a representation of which is shown in FIG. 2. According to FIG. 2, the gray voltage generator 110 generates N gray voltage levels each of which is provided to each of the selectors 122. As described above in reference to FIG. 1, the selector 122 selects the appropriate luminence value presented by the gray voltage levels based on the digital data provided to the selector 122.

The outputs of the selectors 122 are provided to channel buffers 130 each of which is coupled to a channel of the display. Because each channel has a dedicated buffer included in the channel buffer 130, the loading effects discussed above in reference to FIG. 1 may be reduced. However, variations between the buffers included in the channel buffer 130 may introduce differences between the voltage levels driven on the different channels.

SUMMARY

Embodiments according to the present invention can provide circuits, displays and apparatus for providing opposing offsets in amplifier output voltages and methods of operating same. Pursuant to these embodiments, a driver circuit includes a channel amplifier configured to operate in a first mode to provide a channel amplifier output including a positive offset voltage responsive to a first state of a control signal and configured to operate in a second mode to provide the channel amplifier output including a negative offset voltage responsive to a second state of the control signal.

In some embodiments according to the invention, the first mode is noninverting offset operation and the second mode is inverting offset operation. In some embodiments according to the invention, the positive and negative offset voltages are respective voltage differences between the channel amplifier output and an idealized channel amplifier output based on an input to the channel amplifier.

In some embodiments according to the invention, the first state of the control signal is active during a first frame time and the second state of the control signal is active during a second frame time and inactive during the first frame time so that the negative offset voltage substantially cancels the positive offset voltage averaged over the first and second frame times.

In some embodiments according to the invention, the control signal is a first control signal, and the circuit further includes a gamma amplifier coupled to an input of the channel amplifier, the gamma amplifier is configured to operate in noninverting mode to provide a gamma output including a positive offset voltage responsive to a first state of a second control signal and is configured to operate in inverting mode to provide the gamma output including a negative offset voltage responsive to a second state of the second control signal.

In some embodiments according to the invention, the first state of the second control signal is active during the first and second frame times and the second state of the second control signal is active during a third and fourth frame times so that the negative offset voltage in the gamma output substantially subtracts the positive offset voltage in the gamma output averaged over the first to fourth frame times.

In some embodiments according to the invention, the channel amplifier is included in an Active Matrix Organic Light Emitting Diode (AMOLED) based display, a Field Effect LCD, or LCD. In some embodiments according to the invention, the circuit further includes an amplifier mode switch circuit that is configured to switch modes of the channel amplifier during a video signal back-porch or video signal front-porch time interval for a display driven by the channel amplifier.

In some embodiments according to the invention, the circuit further includes a non-volatile memory that is configured to store periods associated with switching of the channel and gamma amplifiers to provide the first and second control signals. In some embodiments according to the invention, the circuit further includes a first switch coupled to first and second inputs of the channel amplifier, the first switch is configured to provide an input voltage to the first input and feedback the channel amplifier output to the second input in the first state and configured to provide the input voltage to the second input and feedback the channel amplifier output to the first input in the second state.

In some embodiments according to the invention, the circuit further includes a second switch that is coupled to first and second alternative outputs of the channel amplifier and is configured to provide the first alternative output as the output of the channel amplifier in the first state and is configured to provide the second alternative output as the output of the channel amplifier in the second state.

In some embodiments according to the invention, the circuit further includes a third switch included in an active load circuit of the channel amplifier that is configured to provide the second alternative output as a bias input of the active load circuit in the first state and is configured to provide the first alternative output as the bias input of the active load circuit in the second state.

In some embodiments according to the invention, a driver circuit includes a gamma amplifier that is coupled to an input of a channel amplifier, the gamma amplifier is configured to operate in non-inverting offset mode to provide a gamma amplifier output including a positive offset voltage responsive to a first state of a control signal and is configured to operate in inverting offset mode to provide the gamma amplifier output including a negative offset voltage responsive to a second state of the control signal.

In some embodiments according to the invention, the first state of the control signal is active during first and second frame times and the second state of the second control signal is active during third and fourth frame times so that the negative offset voltage substantially cancels the positive offset voltage in the gamma amplifier output averaged over the first to fourth frame times.

In some embodiments according to the invention, the circuit further includes a first switch coupled to first and second inputs of the gamma amplifier, the first switch is configured to provide an input voltage to the first input and feedback the gamma amplifier output to the second input in the first state and is configured to provide the input voltage to the second input and feedback the gamma amplifier output to the first input in the second state.

In some embodiments according to the invention, the circuit further includes a second switch coupled to first and second alternative outputs of the gamma amplifier and configured to provide the first alternative output as the output of the gamma amplifier in the first state and configured to provide the second alternative output as the output of the gamma amplifier in the second state.

In some embodiments according to the invention, the circuit further includes a third switch included in an active load circuit of the gamma amplifier configured to provide the second alternative output as a bias input of the active load circuit in the first state and configured to provide the first alternative output as the bias input of the active load circuit in the second state.

In some embodiments according to the invention, a method of operating a driver circuit for a display includes selectively providing opposing offset voltages for inclusion in a channel amplifier output of a driver circuit. In some embodiments according to the invention, selectively providing includes switching from a first mode of operation of a channel amplifier to provide a positive offset voltage in the channel amplifier output to a second mode of operation of the channel amplifier to provide a negative offset voltage in the channel amplifier output.

In some embodiments according to the invention, switching further includes providing the positive offset voltage in the channel amplifier output during a first frame time and providing the negative offset voltage in the channel amplifier output during a second frame time. In some embodiments according to the invention, the method further includes switching from a first mode of operation of a gamma amplifier to provide a positive offset voltage in a gamma amplifier output provided to the channel amplifier to a second mode of operation of the gamma amplifier to provide a negative offset voltage in the gamma amplifier output.

In some embodiments according to the invention, a method of driving a display including Active Matrix Organic Light Emitting Diodes (AMOLEDs), includes generating a channel amplifier output including a first offset voltage using a channel amplifier in a non-inverting offset mode during a first frame time and generating the channel amplifier output including a second offset voltage having a polarity opposing that of the first offset voltage using the channel amplifier in an inverting offset mode during a second frame time so that an average of the channel amplifier outputs during the first and second frame times substantially cancels the first offset voltage from the channel amplifier output.

In some embodiments according to the invention, an input of the channel amplifier is coupled to an output of a gamma amplifier, wherein the method further includes generating a gamma amplifier output including a third offset voltage using the gamma amplifier in a non-inverting offset mode during the first and second frame times and generating the gamma amplifier output including a fourth offset voltage having a polarity opposing that of the third offset voltage using the gamma amplifier in an inverting offset mode during a third frame time and a fourth frame time so that an average of the gamma amplifier outputs during the third and fourth frame times substantially cancels the third offset voltage from the gamma amplifier output.

In some embodiments according to the invention, a method of controlling an offset voltage in an output signal of a driver in a display includes determining a period for a control signal that controls cancellation of an offset voltage generated by a channel amplifier for at least two frame times associated with the display. In some embodiments according to the invention, the method further includes adjusting the period of the control signal responsive to image variation generated by the display using the control signal.

In some embodiments according to the invention, the control signal is a channel amplifier mode control signal used to control a mode of operation of the channel amplifier, and the method further includes adjusting a period of a gamma amplifier control signal used to control a mode of operation of a gamma amplifier providing an output thereof to an input of the channel amplifier.

In some embodiments according to the invention, the method further includes adjusting the period of the gamma amplifier control signal responsive to image variation generated by the display using the gamma amplifier control signal. In some embodiments according to the invention, the method further includes storing the period of the channel amplifier mode control signal and the period of a gamma control signal for use in operation of the display.

In some embodiments according to the invention, an apparatus for adjusting image variation during manufacturing of a display includes a sensor configured to capture an image provided on a display and a processor circuit configured to analyze image variation associated the display providing the image and configured to adjust a period of a control signal of an amplifier used for substantial cancellation of an offset voltage generated by an amplifier used provide the image on the display for at least two frame times associated with the display.

In some embodiments according to the invention, the processor circuit is further configured to adjust the period of the control signal responsive to the image variation generated by the display using the control signal. In some embodiments according to the invention, the control signal is a channel amplifier mode control signal used to control a mode of operation of a channel amplifier wherein the processor circuit is further configured to adjust a period of a gamma amplifier control signal used to control a mode of operation of a gamma amplifier providing an output thereof to an input of the channel amplifier.

In some embodiments according to the invention, the processor circuit is further configured to adjust the period of the gamma amplifier control signal responsive to image variation generated by the display using the gamma amplifier control signal. In some embodiments according to the invention, the processor circuit is further configured to store the period of the channel amplifier mode control signal and the period of a gamma amplifier control signal for use in operation of the display.

In some embodiments according to the invention, an Active Matrix Organic Light Emitting Diode (AMOLED) driver circuit includes a gray voltage generator including a gamma amplifier that is configured to operate in non-inverting offset mode to provide a gamma amplifier output including a positive offset voltage responsive to a first state of a gamma amplifier control signal and configured to operate in inverting offset mode to provide the gamma amplifier output including a negative offset voltage responsive to a second state of the gamma amplifier control signal. A channel buffer circuit is configured to drive a plurality channels of video data, the channel buffer circuit including a plurality of channel amplifiers respectively configured to operate in the non-inverting offset mode to provide a plurality of channel amplifier outputs each including respective positive offset voltages responsive to a first state of a channel amplifier control signal and respectively configured to operate in the inverting offset mode to provide the plurality of channel amplifier outputs each including respective negative offset voltages responsive to a second state of the channel amplifier control signal. An AMOLED display is configured to receive the video data from the plurality of channel amplifiers for display thereon.

In some embodiments according to the invention, the channel amplifier includes a first switch coupled to first and second inputs of the channel amplifier, the first switch is configured to provide an input voltage to the first input and feedback the channel amplifier output to the second input in the first state of the channel amplifier control signal and configured to provide the input voltage to the second input and feedback the channel amplifier output to the first input in the second state of the channel amplifier control signal.

In some embodiments according to the invention, the circuit further includes a second switch coupled to first and second alternative outputs of the channel amplifier and configured to provide the first alternative output as the output of the channel amplifier in the first state of the channel amplifier control signal and configured to provide the second alternative output as the output of the channel amplifier in the second state of the channel amplifier control signal.

In some embodiments according to the invention, the circuit further includes a third switch included in an active load circuit of the channel amplifier configured to provide the second alternative output as a bias input of the active load circuit in the first state of the channel amplifier control signal and configured to provide the first alternative output as the bias input of the active load circuit in the second state of the channel amplifier control signal. In some embodiments according to the invention, the gamma amplifier further comprises respective fist, second, and third switches therein.

DESCRIPTION OF EMBODIMENTS ACCORDING TO THE INVENTION

Figure 1:
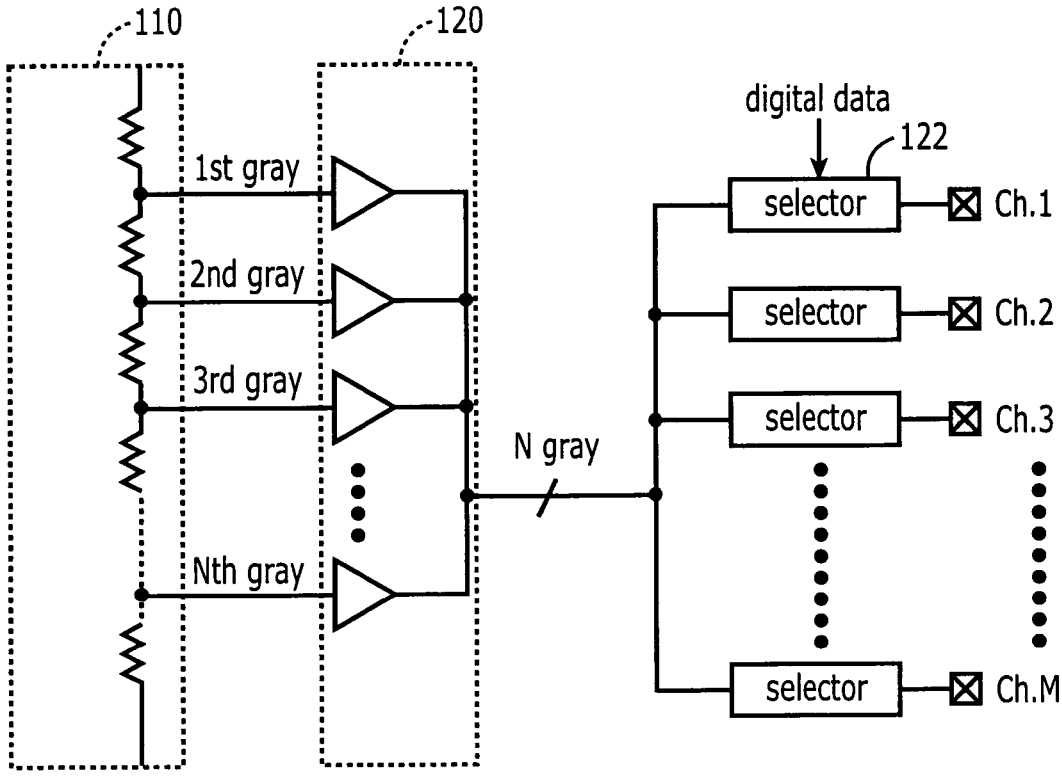
FIGURE 1 (PRIOR ART)
FIG. 1 is a schematic representation of a gamma buffer driver circuit according to the prior art.
Figure 2:
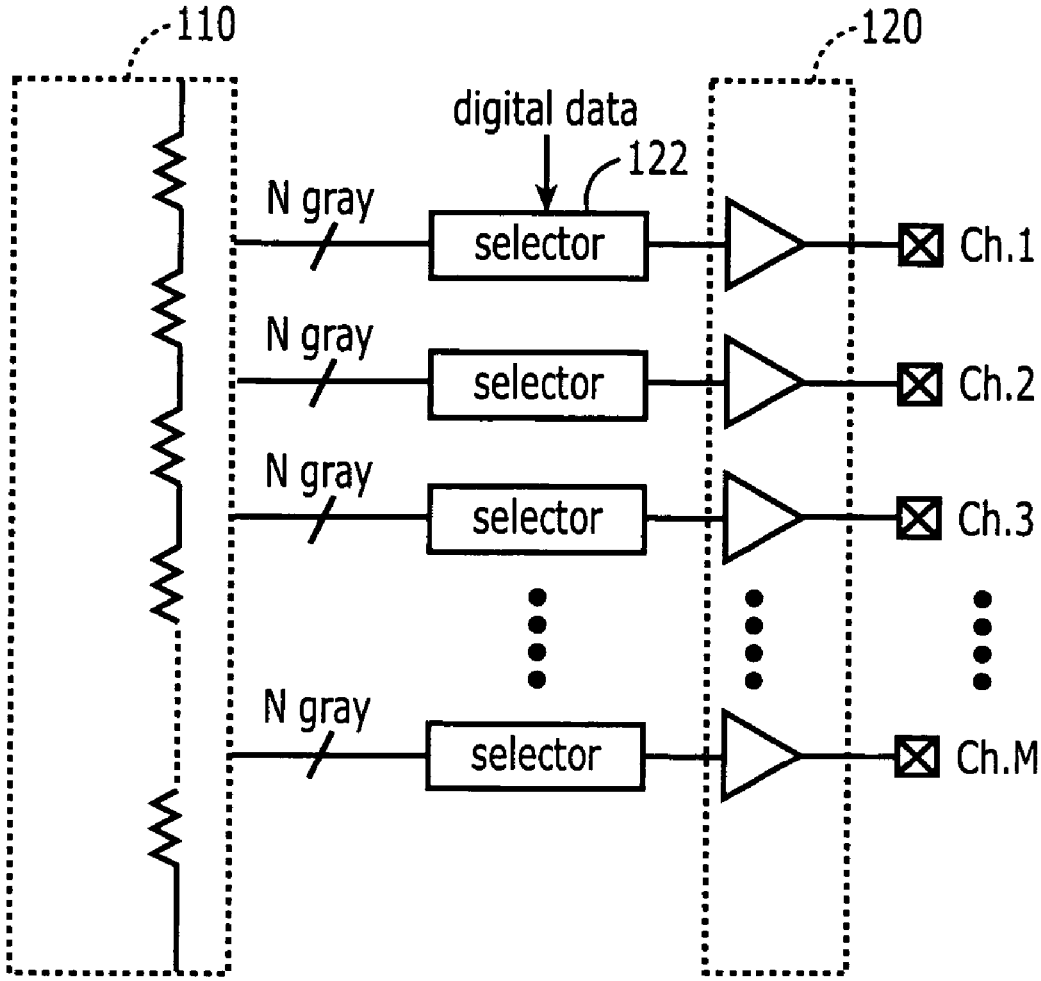
FIGURE 2 (PRIOR ART)
FIG. 2 is a schematic representation of a channel buffer driver circuit according to the prior art.

The present invention now will be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As described herein in greater detail, amplifier circuits can be configured to operate in different modes wherein opposing off-set voltages are generated in those different modes of operation. In particular, in some embodiments according to the invention, the opposing off-set voltages are provided during alternating frame times of a video signal so that an image provided on a display driven by the amplifier may exhibit less image variation due to the integrating function of the human eye over a series of frames of video. Accordingly, generating the opposing off-set voltages in an alternating fashion can produce a cancellation effect over the series of frames so that the image provided on the display can appear of higher quality.

In some embodiments according to the invention, the amplifier circuit is a gamma amplifier circuit included in a gray voltage level generator circuit. Furthermore, the amplifier circuit can be a channel amplifier included in a channel buffer circuit to drive the display. In operation, the gamma amplifiers and/or the channel amplifier circuits are alternatively driven in inverting offset and non-inverting offset modes so that imperfections inherent in the amplifier circuits can be compensated for. For example, if an inherent imperfection in a channel amplifier according to embodiments of the invention produces an output voltage which varies from the theoretical output by 1 millivolt (1 mV) in inverting offset mode, when the channel amplifier is operated in inverting offset mode the same imperfection that generates the positive off-set voltage of 1 mV can produce a negative offset of −1 mV. Therefore, when the operation of the channel amplifier is varied between the inverting and noninverting modes over a series of frame times, an image provided to the display by the channel amplifier may exhibit less variation due to off-sets introduced by the imperfections as the positive and negative off-set voltages tend to substantially cancel one another over time.

In further embodiments according to the invention, the operating modes of the gamma and channel amplifier circuits can be controlled by respective control signals generated by an amplifier mode switch circuit and a nonvolatile memory which can store the periods of the control signals for the gamma amplifier circuits and the channel amplifier circuits. The amplifier mode switch circuit can also control the relative phases of the control signals for the gamma amplifier and channel amplifier circuits.

In still further embodiments according to the invention, an apparatus can provide a semi-autonomous system for adjusting/setting operation of the gamma amplifier and channel amplifier circuits so that during manufacturing the relative phases and periods of the control signals for the gamma amplifier and channel amplifier circuits can be varied until acceptable image variation is detected, whereupon the determined values may be stored in the nonvolatile memory for later use during operation of the display.

Figure 3:
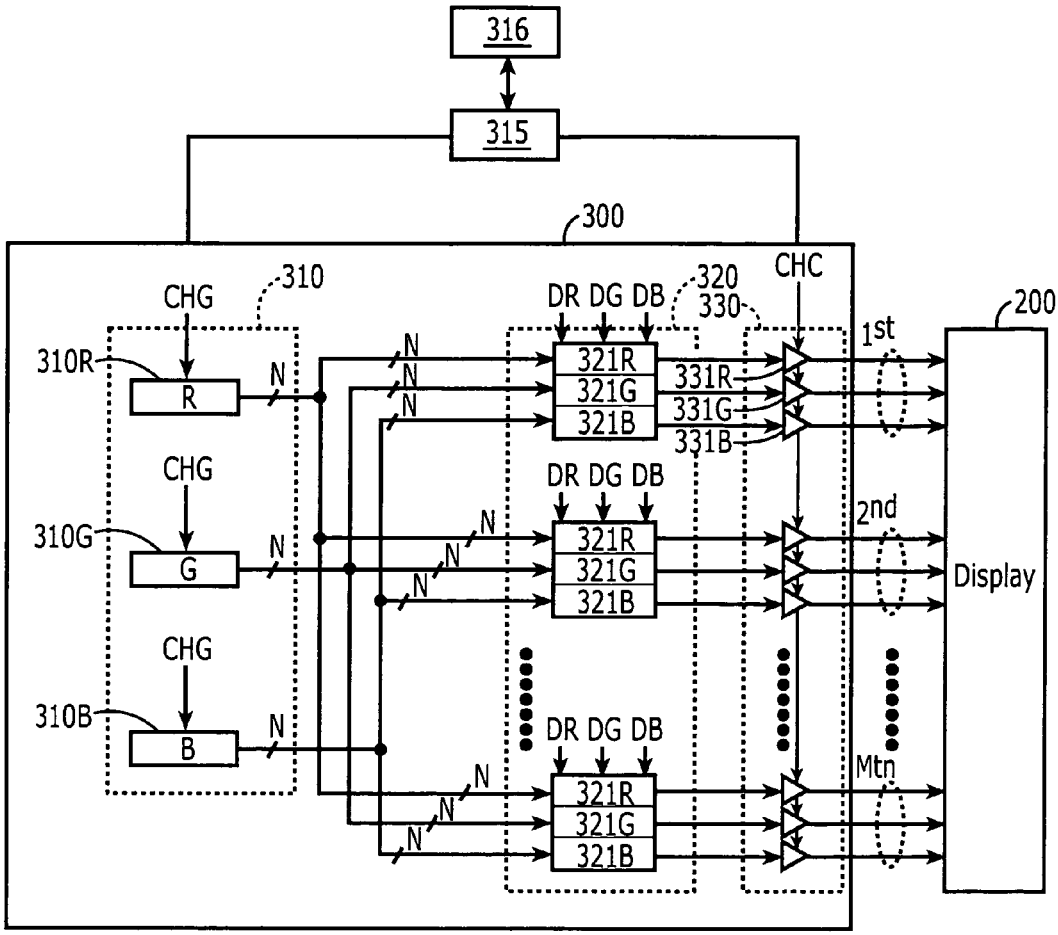
FIG. 3 is a schematic representation of a driver circuit according to some embodiments of the invention.

FIG. 3 is a schematic representation of a driver circuit used to drive a display, such as an AMOLED based display, according to some embodiments of the invention. According to FIG. 3, a gray voltage generator 310 includes separate gray voltage generators 310R, G, and B for red, green and blue data respectively to be driven to a display 200. In some embodiments according to the invention, it may be beneficial to image quality for the gray voltage generator 310 to include separate circuits for red, green and blue gray voltage generators as some types of displays (such as AMOLED based displays) may benefit from different gamma correction for red, green and blue. For example, gamma correction provided for red data may be different than gamma correction provided for green and blue data. Although the descriptions of the gray voltage generator herein focus on color representations based on red, green and blue, it will be understood that other types of color representations may also benefit from separate gamma correction circuits and, this disclosure is not intended to be limited only to separate red, green and blue gamma correction circuits.

Each of the gray voltage generators 310R, G and B generate N gamma corrected gray voltage levels which are provided to a selector 320. In particular, the N gamma corrected gray voltage levels provided by the separate gray voltage generators 310R, G and B, are provided to each of a subselector circuit 321R, G and B dedicating to driving a respective channel of the display 200. For example, as shown in FIG. 3, the gray voltage generator 310R provides the respective N gamma corrected gray voltage levels to a subselector 321R dedicated to the red data driven via the first channel of the display 200. Furthermore, the same N gamma corrected gray voltage levels provided by the gray voltage generator 310R are provided to respective sub-selectors associated with each of the remaining channels of the display 200. Likewise, the N gamma corrected voltage levels provided by the gray voltage generators 310G and 310B are provided to respective subselectors dedicated to the same channels of the display 200. In operation, the selector 320 selects the gamma corrected gray voltage levels provided thereto based on digital data DR, DG and DB (i.e., digital data for red, green and blue). In other words, the digital data can be used to select the appropriate level of the gamma corrected gray voltage level for a particular color.

Still referring to FIG. 3, a channel buffer circuit 330 receives the selected gamma corrected gray voltage levels from the selector 320 which are driven over the respective dedicated channels to the display 200. The channel buffer circuit 330 includes a plurality of channel amplifiers 331R, G, and B dedicated to each of the channels of the display 200. For example, as shown in FIG. 3, the channel buffer circuit 330 includes channel amplifiers 331R, G, and B dedicated to driving data to the display 200 via the first channel. Likewise, each of the remaining channels associated with the display 200 has an associated plurality of dedicated channel amplifiers.

It will be understood that in some embodiments according to the invention, the channel amplifiers 331 included in the channel buffer circuit 330 can operate in a similar fashion to that described above in reference to the gamma amplifiers included in the gray voltage generator 310. In particular, the channel amplifiers can operate in inverting offset and non-inverting offset modes based on the control signals provided thereto. Therefore, in some embodiments according to the invention, inherent defects in the channel amplifiers (which may otherwise produce undesirable image artifacts in the form of voltage variations) can be compensated for by operating the amplifiers in alternating inverting/non-inverting offset modes so that alternating positive and negative voltage offsets may be included in the data driven to the display 200. Over a series of frame times, the eye of an observer may integrate the variation from frame to frame so that any undesirable image artifacts produced by the offsets tend to be integrated with one another (i.e., averaged) so as to be reduced.

Still referring to FIG. 3, an amplifier mode switch circuit 315 generates first and second control signals to control the operating mode of the gamma and channel amplifiers. In particular, the amplifier mode switch circuit 315 provides a gamma chop control signal (CHG) to control the operating mode of the gamma amplifiers included in the gray voltage generator 310. Likewise, the amplifier mode switch circuit 315 provides a channel chop control signal (CHC) to control operation of the channel amplifiers included in the channel buffer circuit 330.

In operation, the amplifier mode switch circuit 315 controls the period and relative phases of the CHG and CHC signals so as to produce the substantial canceling effect of the positive and negative voltage offsets described above. It will be understood that in some embodiments according to the invention, the CHG signal and the CHC signal may both be provided so that the gamma and channel amplifiers both operate to provide the substantial canceling effect of the positive and negative offset voltages. However, in other embodiments according to the invention, the amplifier mode switch circuit 315 may provide only the CHG signal or only the CHC signal so that the respective amplifier (i.e., the gamma amplifier or the channel amplifier) provides the substantial canceling effect of including the positive and negative off-set voltages in alternating frames. As further shown in FIG. 3, a nonvolatile memory 316 is coupled to the amplifier mode switch circuit 315 so that the periods and relative phases of the CHG and CHC signals may be stored for use during operation of the display 200.

Figure 4:
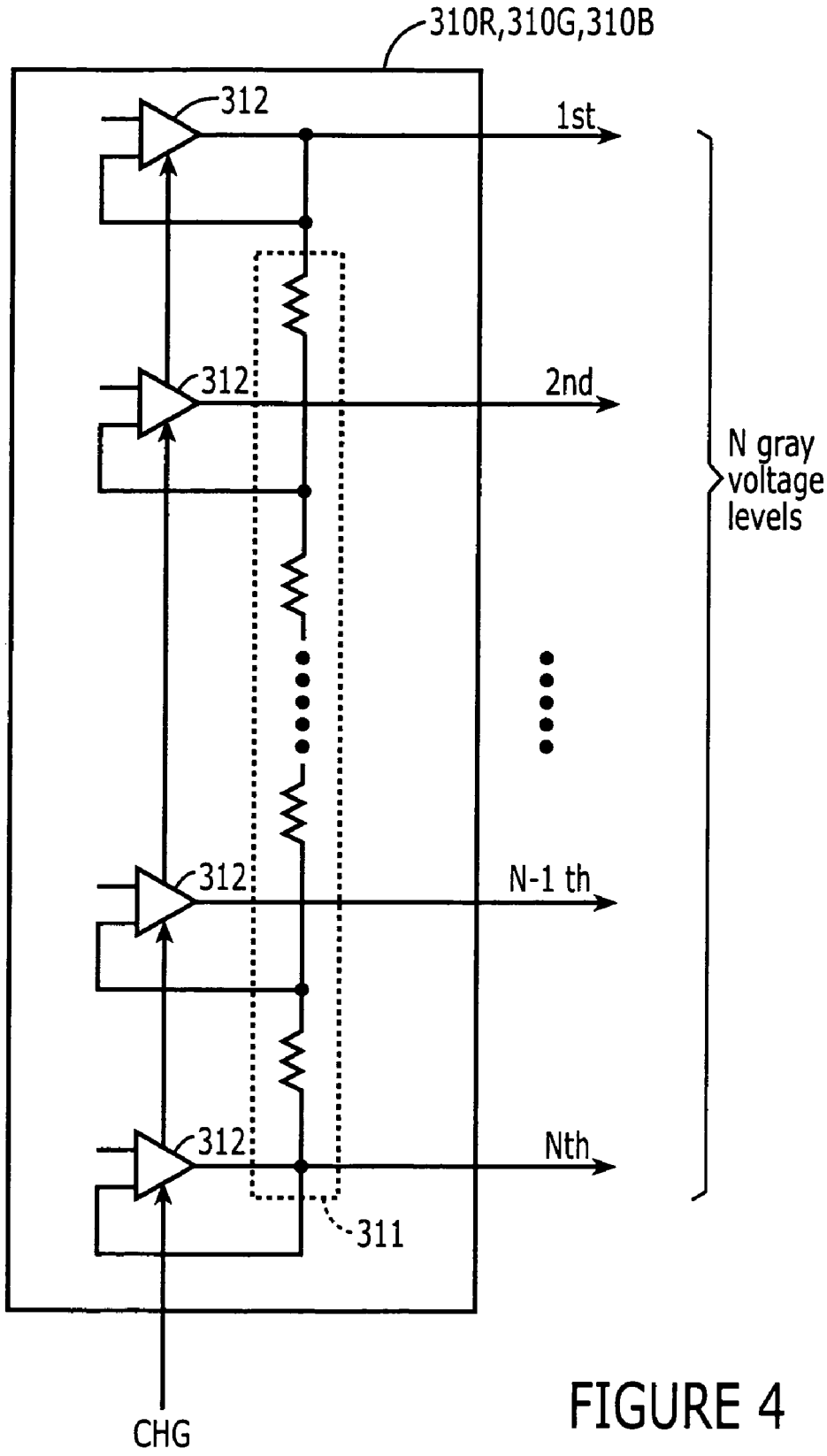
FIG. 4 is a schematic representation of a gray voltage generator circuit according to some embodiments of the invention.

FIG. 4 is a schematic representation of a selected one of the gray voltage generators 310R, G, and B, included in the gray voltage generator 310. As shown in FIG. 4, the gray voltage generator 310R, G, and B includes a resistor network 311 to provide the scaling between the different gray voltage levels provided by the gray voltage generator 310R, G, and B. Gamma amplifiers 312 are coupled to the resistor network 311 to provide the gamma correction for the respective color to which the voltage generator 310R, G, and B is dedicated. As further shown in FIG. 4, the CHG (i.e., gamma chop) control signal is provided to each of the gamma amplifiers 312. As described above, the CHG control signal is provided by the amplifier mode switch circuit 315 to control the operational mode of the gamma amplifiers 312. In particular, in some embodiments according to the invention, the gamma amplifiers 312 operate in the non-inverting offset mode when the CHG control signal is in a first state (i.e., "on") and operate in inverting offset mode when the CHG control signal is in a second state (i.e., "off"). Therefore, inherent imperfections in the gamma amplifiers 312 which may otherwise introduce an off-set voltage into the output of the gamma amplifier can be compensated for by operating the gamma amplifiers 312 alternatively in inverting and non-inverting offset modes so that the effects of the positive and negative off-set voltages can substantially cancel one another over time.

Figure 5:
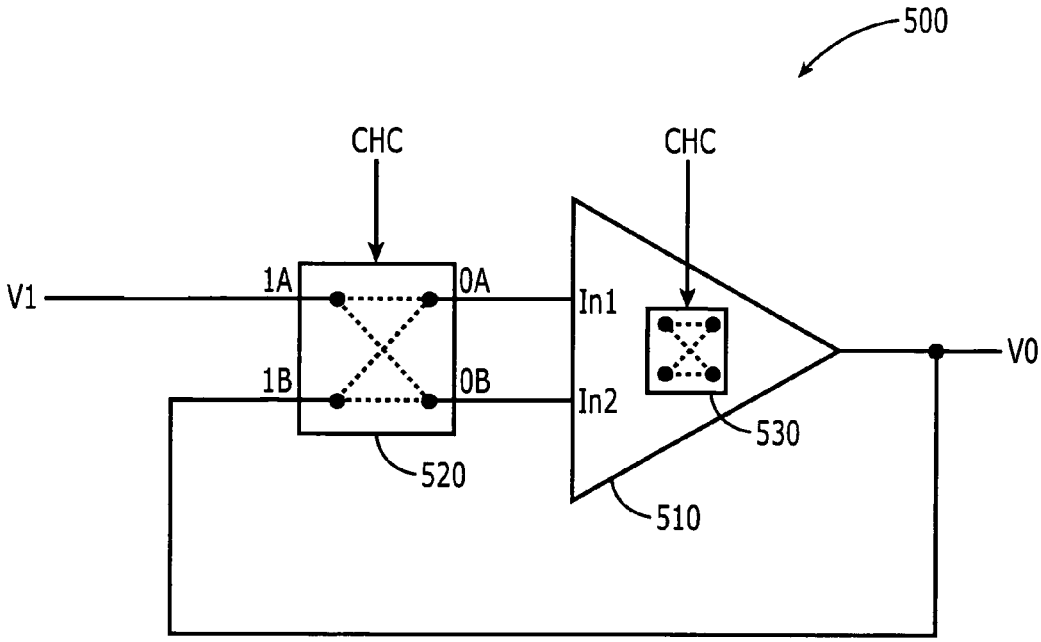
FIG. 5 is a schematic representation of an amplifier circuit according to some embodiments of the invention.

FIG. 5 is a schematic representation of an amplifier 500 which can be used as the gamma amplifier 312 shown in FIG. 4. It will be further understood that the amplifier 500 can be used to provide the channel amplifier included in the channel buffer circuit 330 described above in reference to FIG. 3. Referring to FIG. 5, the amplifier 500 includes a first switch 520 coupled to first and second inputs of an amplifier circuit 510. The first switch 520 is configured to switch inputs provided thereto to either of two output terminals of the first switch 520 in response to a control signal provided thereto (i.e., CHC or CHG). In a first mode of operation, the first switch 520 can provide an input A (IA) to an output A (OA) and provide an input B (IB) to an output B (OB). In a second mode of operation, the first switch 520 can switch the inputs described above to the other outputs. In particular, in the second mode of operation, the first switch 520 can provide IA to OB and IB to OA.

Still referring to FIG. 5, the amplifier 500 also includes second and third switches 530 which also operate under the control of the control signal provided to the first switch 520. In operation, the second and third switches 530 operate to re-configure the amplifier circuit 510 to be in either inverting or non-inverting offset mode. Therefore, in conjunction with the operation of the first switch 520, the second and third switches 530 can enable amplifier 500 to operate in inverting or noninverting offset modes so that an off-set voltage generated by the amplifier 500 can be inverted by switching the mode of the amplifier 500 and, therefore, generate an opposing off-set voltage as part of the output signal of the amplifier 500, which can improve apparent image quality.

Figure 6:
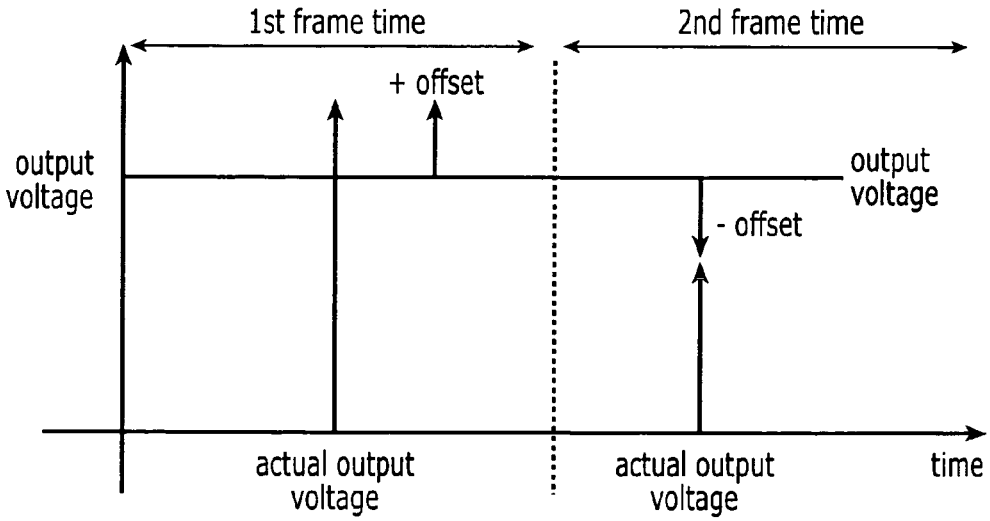
FIG. 6 is a graphical representation showing opposing off-sets in amplifier output voltages over multiple frame times according to some embodiments of the invention.

FIG. 6 is a graph that illustrates positive and negative off-sets included in voltages output by driver circuits according to some embodiments of the invention. Referring to FIG. 6, during a first frame time, the amplifier can be operated in noninverting off-set mode so that the output voltage provided by the driver actually exceeds an idealized output which would otherwise be provided based on the input if imperfections in the amplifier were removed. Accordingly, the output voltage during the first frame time includes the positive off-set shown. During a second frame time, the operational mode of the amplifier is changed to inverting off-set mode so that the imperfections in the amplifier provide a negative off-set component as part of the voltage signal provided by the amplifier. Therefore, when the output voltage is averaged over the first and second frame times, the opposing offset voltages included in the output voltage tend to substantially cancel one another and provide an output voltage which approximates a more idealized amplifier output.

Figure 7:
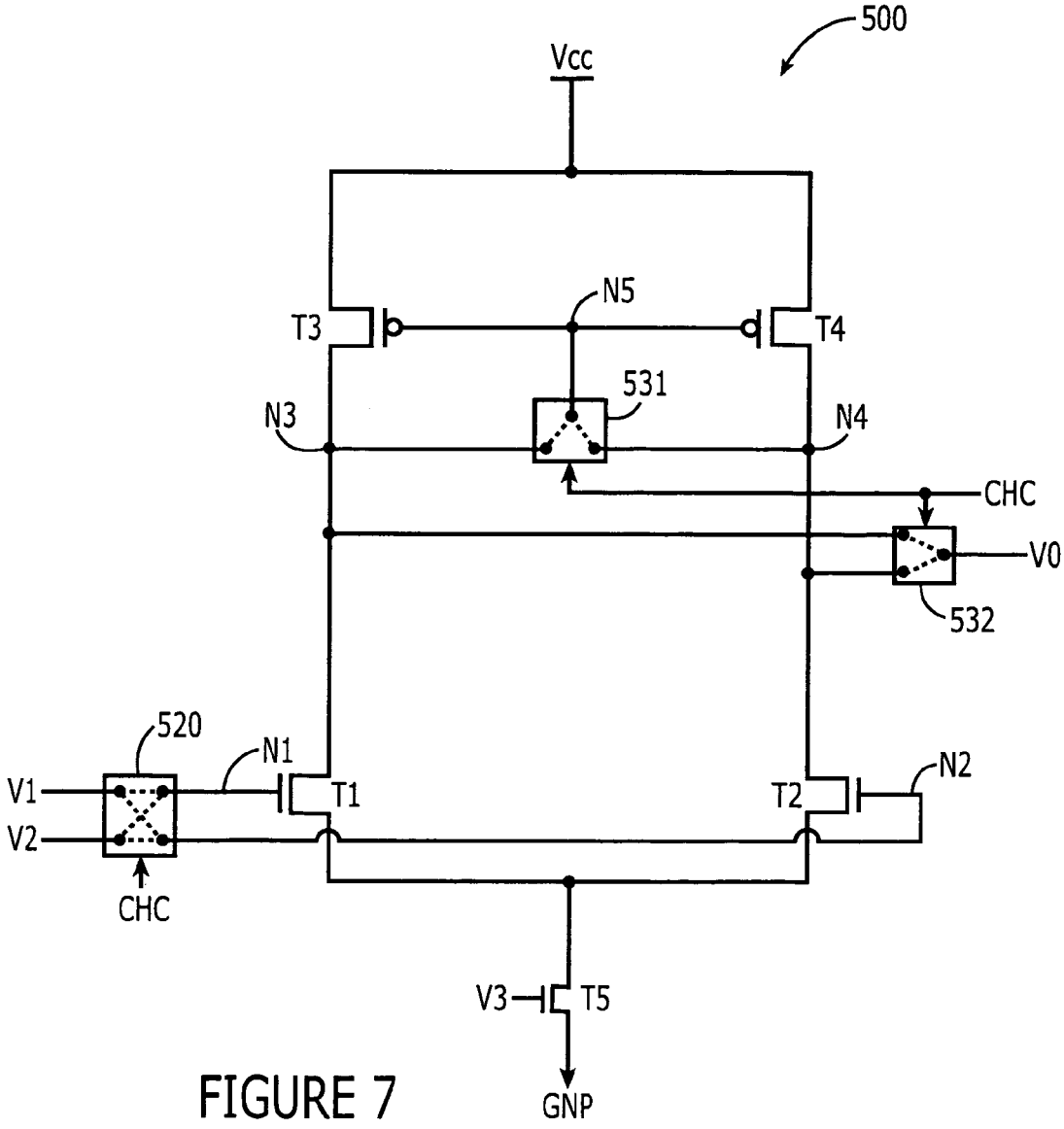
FIG. 7 is a schematic representation of a gamma amplifier and/or a channel amplifier according to some embodiments of the invention.

FIG. 7 is a more detailed schematic diagram that illustrates gamma amplifiers and channel amplifiers according to some embodiments of the invention. In particular, as shown in FIG. 7, amplifier 500 is configured as a differential amplifier which amplifies a difference between inputs VI and V2 via transistors T1 and T2. As further shown in FIG. 7, transistors T3 and T4 are connected in a current mirror configuration to provide an active load to the differential amplifier. As further shown in FIG. 7, the first switch 520 is configured to switch inputs VI and V2 between the inputs to transistors T1 and T2 based on the state of the control signal provided thereto.

It will be understood that the control signal provided to the first switch 520 depends on which circuit the amplifier is included within. For example, if the amplifier 500 is a gamma amplifier, the control signal provided to the first switch 520 is the gamma chop signal, whereas if the amplifier 500 is a channel amplifier, the control signal is the channel chop control signal. As further shown in FIG. 7, a second switch 531 is configured to switch a bias signal for the active load circuit (T3 and T4). In particular, the second switch 531 provides either a first alternate output of the amplifier (N4) as the bias signal or a second alternative output of the amplifier (N3) as the bias signal to the active load. Furthermore, a third switch 532 is configured to select between the first and second alternate outputs (N4, N3) based on the state of the control signal provided to the amplifier as discussed above in reference to the first switch 520.

Slight imperfections or differences between the transistors T1 and T2 (e.g., difference in size) can otherwise lead to small offsets included in the differential amplified output voltage. Accordingly, in some embodiments according to the invention, in a non-inverting offset mode, the output voltage includes a positive offset voltage. Whereas, in an inverting offset mode of operation, the output of the amplifier includes a negative offset voltage. Therefore, when the operation of the amplifier is switched between the inverting and noninverting modes, the positive and negative offset voltages can substantially cancel one another when the output voltage is observed over time.

Figure 8:
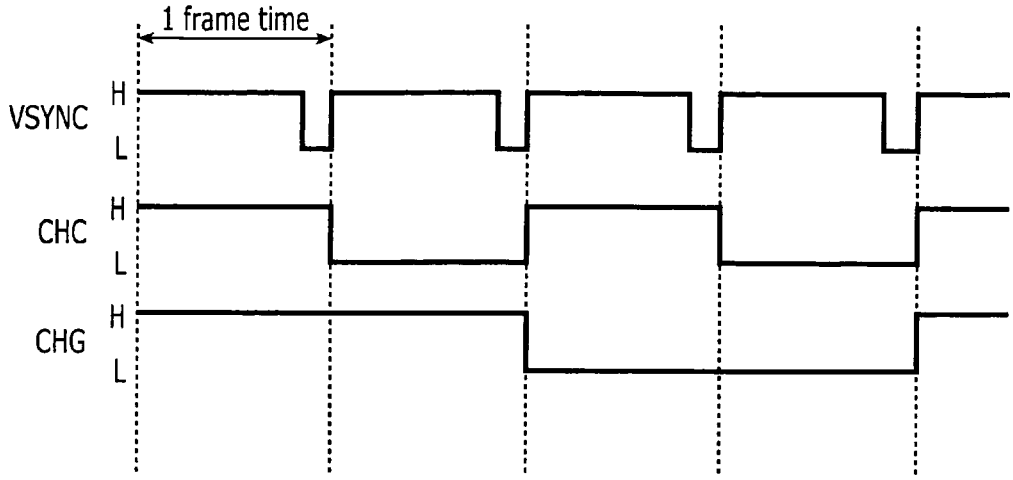
FIG. 8 is a timing diagram illustrating the control of operational modes of the channel amplifier and/or gamma amplifier according to some embodiments of the invention.

FIG. 8 is a timing diagram that represents the operation of the gamma chop control signal and channel chop control signal according to some embodiments of the invention. In particular, the state of the channel chop control signal (CHC) can alternate every frame time, whereas the gamma chop control signal (CHG) can operate at one half the frequency of the channel chop control signal. It will be understood that the periods and relative phases of the control signals used to control the channel and gamma amplifiers according to embodiments of the invention can be different than those illustrated in FIG. 8. Furthermore, in some embodiments according to the invention, the channel chop control signal or the gamma chop control signal may be used individually. As further shown in FIG. 8, the channel chop control signal is active during a first frame time and inactive during a second frame time. This on/off operation may repeat every frame time. In contrast, the gamma chop control signal is active for two consecutive frame times and inactive for the following two consecutive frame times.

Figure 9:
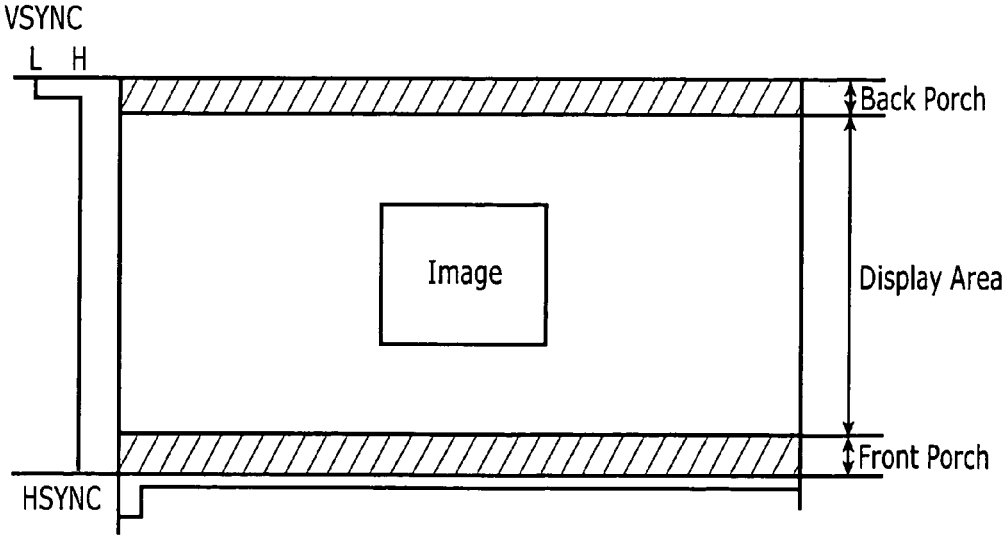
FIG. 9 is a schematic representation of nominal video timing associated with a display including a front porch time and a back porch time according to some embodiments of the invention.

According to FIG. 9, the gamma chop control signal and channel chop control signal can be switched during times during which no video is displayed. For example, the channel chop control signal and gamma chop control signal may be switched during either the front porch of the video signal or the back porch of the video signal.

Figure 10:
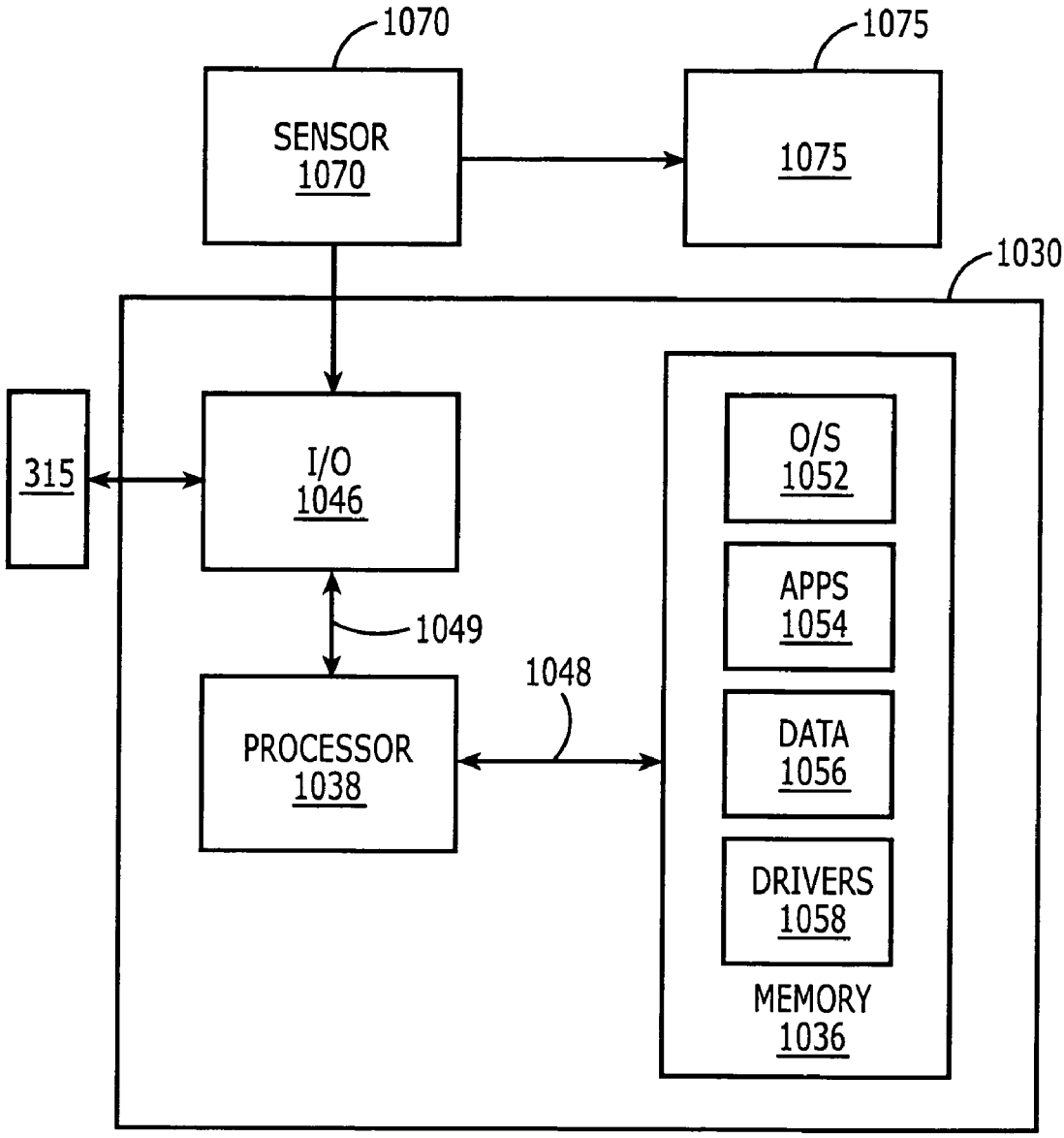
FIG. 10 is a block diagram that illustrates a test apparatus that may be used to reduce variation in image display according to some embodiments of the invention.

FIG. 10 is a block diagram of an apparatus that can be used to semi-automatically adjust the periods and phases of the control signals used to operate the gamma and channel amplifiers according to some embodiments of the invention. According to FIG. 10, a system 1030 can be configured to adjust the control signals (i.e., the gamma chop control signal and channel chop control signal) to modify the operation of the drivers used to provide data to a display 1075.

The system 1030 includes a processor 1038, a memory 1036 and input/output (I/O) circuits 1046. The system 1030 may be incorporated in, for example, a general purpose computer, server, or the like. The processor 1038 communicates with the memory 1036 via an address/data bus 1048 and communicates with the input/output circuits 1046 via an address/data bus 1049.

The components in the system 1030 may be known components such as those used in many data processing systems, which may be configured to operate as described herein. In particular, the processor 1038 can be any commercially available or custom microprocessor, microcontroller, digital signal processor or the like. The memory 1036 may include any memory devices containing the software and data used to implement the functionality circuits or modules used in accordance with embodiments of the present invention. The memory 1036 can include, but is not limited to, the following types of devices: cache, ROM, PROM, EPROM, EEPROM, flash memory, SRAM, DRAM and magnetic disk.

The memory 1036 may include several categories of software to provide operation of the system 1030: an operating system 1052; application programs 1054 including the software to provide the operations of the embodiments described herein; input/output device drivers 1058; and data 1056.

As will be appreciated by those of skill in the art, the operating system 1052 may be any operating system suitable for use with a data processing system, such as OS/2, AIX or zOS from International Business Machines Corporation, Armonk, N.Y., Windows 95, Windows98, Windows2000 or WindowsXP from Microsoft Corporation, Redmond, Wash., Unix or Linux.

The data 1056 represents the static and dynamic data used by the application programs 1054, the operating system 1052, and the input/output device drivers 1058, that may reside in the memory 1036. The data 1056 can include predetermined parameters or algorithms for controlling the CHG and CHC control signals, data used to measure the image quality obtained via the sensor etc. The input/output device drivers 1058 typically include software routines accessed through the operating system 1052 by the application programs 1054 to communicate with devices such as the input/output circuits 1046 and the memory 1036.

In some embodiments according to the invention, the applications software 1054 can be configured to provide CHG and/or CHC control signal parameters (i.e., periods and phases) to the amplifier mode switch circuit 315, which provides the channel chop and gamma chop control signals to the gray voltage generator and channel buffer circuits as described above. In operation, the system 1030 can adjust the control signals via the amplifier mode switch circuit 315 and monitor the resulting image quality via a sensor 1070. The system 1030 evaluates the data collected by the sensor 1070 and determines whether further adjustments to the control signals may be necessary.

Once the system 1030 determines that the image quality is acceptable, the values provided to the drivers can be saved in the nonvolatile memory 316 (shown above in reference to FIG. 3). Therefore, during the manufacturing of the display 1075, the control signals may be varied according to a predetermined evaluation process whereupon acceptable values for the control signals are stored so that they may be provided to the channel and gamma amplifiers for operation of the display in a post-manufacturing environment.

As described above, in some embodiments according to the invention, the amplifier circuit is a gamma amplifier circuit included in a gray voltage level generator circuit. Furthermore, the amplifier circuit can be a channel amplifier included in a channel buffer circuit to drive the display. In operation, the gamma amplifiers and/or the channel amplifier circuits are alternatively driven in inverting offset and non-inverting offset modes so that imperfections inherent in the amplifier circuits can be compensated for. For example, if an inherent imperfection in a channel amplifier according to embodiments of the invention produces an output voltage which varies from the theoretical output by 1 millivolt (1 mV) in inverting offset mode, when the channel amplifier is operated in inverting offset mode the same imperfection that generates the positive off-set voltage of 1 mV can produce a negative offset of −1 mV. Therefore, when the operation of the channel amplifier is varied between the inverting and non-inverting modes over a series of frame times, an image provided to the display by the channel amplifier may exhibit less variation due to off-sets introduced by the imperfections as the positive and negative off-set voltages tend to substantially cancel one another over time.

In further embodiments according to the invention, the operating modes of the gamma and channel amplifier circuits can be controlled by respective control signals generated by an amplifier mode switch circuit and a nonvolatile memory which can store the periods of the control signals for the gamma amplifier circuits and the channel amplifier circuits. The amplifier mode switch circuit can also control the relative phases of the control signals for the gamma amplifier and channel amplifier circuits.

In still further embodiments according to the invention, an apparatus can provide a semi-autonomous system for adjusting/setting operation of the gamma amplifier and channel amplifier circuits so that during manufacturing the relative phases and periods of the control signals for the gamma amplifier and channel amplifier circuits can be varied until acceptable image variation is detected, whereupon the determined values may be stored in the nonvolatile memory for later use during operation of the display.

In the drawings and specification, there have been disclosed embodiments of the invention and, although specific terms are employed, they are used in a generic and descriptive sense only and not for purposes of limitation, the scope of the invention being set forth in the following claims.

What is claimed:

1. A driver circuit comprising:

a channel amplifier configured to operate in a first mode to provide a channel amplifier output including a positive offset voltage responsive to a first state of a first control signal during a first frame time and configured to operate in a second mode to provide the channel amplifier output including a negative offset voltage responsive to a second state of the first control signal during a second frame time;

a gamma amplifier coupled to an input of the channel amplifier, the gamma amplifier configured to operate in non-inverting mode to provide a gamma output including a positive offset voltage responsive to a first state of a second control signal and configured to operate in inverting mode to provide the gamma output including a negative offset voltage responsive to a second state of the second control signal;

a first switch coupled to first and second inputs of the channel amplifier, the first switch configured to provide an input voltage to the first input and feedback the channel amplifier output to the second input in the first state of the first control signal and configured to provide the input voltage to the second input and feedback the channel amplifier output to the first input in the second state of the first control signal; and a second switch coupled to first and second inputs of the gamma amplifier, the second switch configured to provide an input voltage to the first input and feedback the gamma amplifier output to the second input in the first state of the second control signal and configured to provide the input voltage to the second input and feedback the gamma amplifier output to the first input in the second state of the second control signal, wherein the first control signal operates at a first frequency and the second control signal operates at a second frequency that is about one half the first frequency.

2. A circuit according to claim 1 wherein the first mode comprises non-inverting offset operation and the second mode comprises inverting offset operation.

3. A circuit according to claim 1 wherein the positive and negative offset voltages comprise respective voltage differences between the channel amplifier output and an idealized channel amplifier output based on an input to the channel amplifier.

4. A circuit according to claim 1 wherein the first state of the first control signal is active during a first frame time and the second state of the first control signal is active during a second frame time and inactive during the first frame time so that the negative offset voltage substantially cancels the positive offset voltage averaged over the first and second frame times.

5. A circuit according to claim 1, wherein the first state of the second control signal is active during the first and second frame times and the second state of the second control signal is active during a third and fourth frame times so that the negative offset voltage in the gamma amplifier output substantially subtracts the positive offset voltage in the gamma amplifier output averaged over the first to fourth frame times.

6. A circuit according to claim 1 wherein the channel amplifier is included in an Active Matrix Organic Light Emitting Diode (AMOLED) based display, a Field Effect LCD, or LCD.

7. A circuit according to claim 1 further comprising:

an amplifier mode switch circuit configured to switch modes of the channel amplifier during a video signal back-porch or video signal front-porch time interval for a display driven by the channel amplifier.

8. A circuit according to claim 1 further comprising:

a non-volatile memory configured to store periods associated with switching of the channel and gamma amplifiers to provide the first and second control signals.

9. A method of operating a driver circuit for a display, the method comprising:

selectively providing opposing offset voltages for inclusion in a channel amplifier output of a driver circuit; and switching from a first mode of operation of a channel amplifier to provide a positive offset voltage in the channel amplifier output responsive to a first state of a first control signal to a second mode of operation of the channel amplifier to provide a negative offset voltage in the channel amplifier output during a video signal front-porch or back-porch time responsive to a second state of the first control signal; and switching from a first mode of operation of a gamma amplifier to provide a positive offset voltage in a gamma amplifier output provided to the channel amplifier responsive to a first state of a second control signal to a second mode of operation of the gamma amplifier to provide a negative offset voltage in the gamma amplifier output responsive to a second state of the second control signal, wherein the first control signal operates at a first frequency and the second control signal operates at a second frequency that is about one half the first frequency.

10. A method according to claim 9 wherein switching further comprises:

providing the positive offset voltage in the channel amplifier output during a first frame time; and providing the negative offset voltage in the channel amplifier output during a second frame time.

11. A method of driving a display including Active Matrix Organic Light Emitting Diodes (AMOLEDs), the method comprising:

generating a channel amplifier output including a first offset voltage using a channel amplifier in a non-inverting offset mode during a first frame time responsive to a first state of a first control signal; and generating the channel amplifier output including a second offset voltage having a polarity opposing that of the first offset voltage using the channel amplifier in an inverting offset mode during a second frame time responsive to a second state of the first control signal so that an average of the channel amplifier outputs during the first and second frame times substantially cancels the first offset voltage from the channel amplifier output;

generating a gamma amplifier output including a third offset voltage using the gamma amplifier in a non-inverting offset mode during the first and second frame times responsive to a first state of a second control signal; and generating the gamma amplifier output including a fourth offset voltage having a polarity opposing that of the third offset voltage using the gamma amplifier in an inverting offset mode during a third frame time and a fourth frame time responsive to a second state of the second control signal so that an average of the gamma amplifier outputs during the third and fourth frame times substantially cancels the third offset voltage from the gamma amplifier output, wherein the first control signal operates at a first frequency and the second control signal operates at a second frequency that is about one half the first frequency.

12. A method of controlling an offset voltage in an output signal of a driver in a display, the method comprising:

determining a period for a channel amplifier mode control signal that controls cancellation of an offset voltage generated by a channel amplifier for at least two frame times associated with the display; and adjusting a period of a gamma amplifier control signal used to control a mode of operation of a gamma amplifier providing an output thereof to an input of the channel amplifier, wherein the channel amplifier mode control signal operates at a first frequency and the gamma amplifier control signal operates at a second frequency that is about one half the first frequency.

13. A method according to claim 12 further comprising:

adjusting the period of the control signal responsive to image variation generated by the display using the control signal.

14. A method according to claim 12 further comprising:

adjusting the period of the gamma amplifier control signal responsive to image variation generated by the display using the gamma amplifier control signal.

15. A method according to claim 14 further comprising:

storing the period of the channel amplifier mode control signal and the period of a gamma control signal for use in operation of the display.

16. An Active Matrix Organic Light Emitting Diode (AMOLED) driver circuit comprising:

a gray voltage generator including a gamma amplifier configured to operate in non-inverting offset mode to provide a gamma amplifier output including a positive offset voltage responsive to a first state of a gamma amplifier control signal and configured to operate in inverting offset mode to provide the gamma amplifier output including a negative offset voltage responsive to a second state of the gamma amplifier control signal;

a channel buffer circuit configured to drive a plurality channels of video data, the channel buffer circuit including a plurality of channel amplifiers respectively configured to operate in the non-inverting offset mode to provide a plurality of channel amplifier outputs each including respective positive offset voltages responsive to a first state of a channel amplifier control signal during a first frame time and respectively configured to operate in the inverting offset mode to provide the plurality of channel amplifier outputs each including respective negative offset voltages responsive to a second state of the channel amplifier control signal during a second frame time;

a gamma amplifier coupled to an input of a channel amplifier, the gamma amplifier configured to operate in non-inverting offset mode to provide a gamma amplifier output including a positive offset voltage responsive to a first state of a control signal and configured to operate in inverting offset mode to provide the gamma filter amplifier output including a negative offset voltage responsive to a second state of the control signal; and an AMOLED display configured to receive the video data from the plurality of channel amplifiers for display thereon, wherein the channel amplifier control signal operates at a first frequency and the gamma amplifier control signal operates at a second frequency that is about one half the first frequency.

* * * * *